US005568761A

United States Patent [19]

Legendre

[11] Patent Number: 5,568,761

[45] Date of Patent: Oct. 29, 1996

[54] PNEUMATIC JACK

[75] Inventor: Dominique Legendre, Le Mans, France

[73] Assignee: Corea S.A., Spay, France

[21] Appl. No.: 351,425

[22] PCT Filed: Jun. 10, 1993

[86] PCT No.: PCT/FR93/00555

§ 371 Date: Jan. 11, 1995

§ 102(e) Date: Jan. 11, 1995

[87] PCT Pub. No.: WO93/25817

PCT Pub. Date: Dec. 23, 1993

[30] Foreign Application Priority Data

Jun. 10, 1992 [FR] France ..... 93/06970

[51] Int. Cl.[6] ..... F01B 19/00

[52] U.S. Cl. ..... 92/46; 92/34; 92/37; 92/48; 92/64; 92/59; 92/98 R; 92/128; 92/151

[58] Field of Search ..... 92/34, 48, 49, 92/50, 62, 64, 75, 117 R, 151, 128, 93, 98 R, 37, 45, 46, 59

[56] References Cited

U.S. PATENT DOCUMENTS

| | | | |
|---|---|---|---|
| 1,141,360 | 6/1915 | Rudd | 92/46 |
| 2,712,321 | 7/1955 | Grogan | 92/49 |
| 3,442,180 | 5/1969 | Babic | 92/62 |
| 3,446,241 | 5/1969 | Skoli | 92/64 |
| 3,975,989 | 8/1976 | Hirmann | 92/64 |
| 5,079,998 | 1/1992 | Peterson et al. | 92/62 |

FOREIGN PATENT DOCUMENTS

| | | | |
|---|---|---|---|
| 2519955 | 7/1983 | France . | |
| 2306713 | 8/1974 | Germany . | |
| 171206 | 8/1934 | Switzerland | 92/48 |
| 513977 | 10/1939 | United Kingdom | 92/48 |
| 1059954 | 2/1967 | United Kingdom . | |

*Primary Examiner*—Thomas E. Denion
*Attorney, Agent, or Firm*—Young & Thompson

[57] ABSTRACT

Pneumatic jack of the type comprising a rigid body (1) joined to the outer edge of a deformable membrane (2) so as to delimit with the latter a chamber of variable volume capable of being subjected to either atmospheric pressure of a negative pressure, via an air inlet located in the chamber. The body (1) and the membrane (2) each have, substantially in the center, an opening (15, 14) that can be closed, at least partially, by a disc (4, 3). Application in multiple position jacks.

12 Claims, 5 Drawing Sheets

PNEUMATIC JACK

FIELD OF THE INVENTION

The present invention relates to a pneumatic jack comprising a body delimiting with a membrane a chamber adapted to be subjected to negative pressure or to atmospheric pressure and a jack shaft actuated by the deformation of the membrane.

BACKGROUND OF THE INVENTION

Pneumatic jacks are known for a large number of uses. Most of these jacks have a jack body and a shaft displaceable longitudinally relative to the jack body. This type of arrangement permits obtaining jacks adapted to occupy for example three working positions, one corresponding to the maximum extension of said shaft, the other corresponding to the minimum extension of said shaft and the third corresponding to an intermediate extension. In this case, the jack body comprises two membranes delimiting three chambers and the shaft is secured to the central portion of each of the membranes, which complicates the production of the assembly and limits the number of positions adapted to be occupied.

The object of the present invention is to provide a jack whose number of working positions is unlimited and which is susceptible of being produced by means of a small number of simple and standard pieces.

Another object of the invention is to provide a modular jack comprising several chambers, one chamber corresponding to a module, said modules being adapted to be mounted in series, in parallel or permitting the production of a push-pull type actuator.

SUMMARY OF THE INVENTION

The invention relates for this purpose to a pneumatic jack of the type comprising a rigid jack body secured to the external edge of a deformable membrane so as to limit with this latter a chamber of variable volume adapted to be subjected either to atmospheric pressure, or to negative pressure, by means of an air inlet provided in said chamber, characterized in that the body and the membrane each have, substantially centrally, an opening adapted to be closed at least partially by a disk.

According to one preferred embodiment of the invention, the body has the shape of a basin whose peripheral edge serves to maintain the membrane and whose surface forming a bottom comprises the opening closed at least partially by the disk. As to the disk serving to close at least partially the membrane, it is mounted on the internal edge of the membrane and is so shaped as to come into abutment against the bottom of the basin when the chamber is subjected to negative pressure.

According to another characteristic of the invention, the jack comprises several contiguous chambers obtained by the assembly of modules each comprising at least one body and one membrane, the connection between two adjacent modules being effected by a single and same disk closing at least partially both the body of a module and the membrane of the adjacent module and maintaining securely the membrane of the body.

BRIEF DESCRIPTION OF THE DRAWINGS

Other characteristics and advantages of the invention will become apparent from a reading of the description which follows and the accompanying drawings, which description and drawings are given only by way of example. In these drawings.

DETAILED DESCRIPTION OF THE INVENTION

Figure 2:
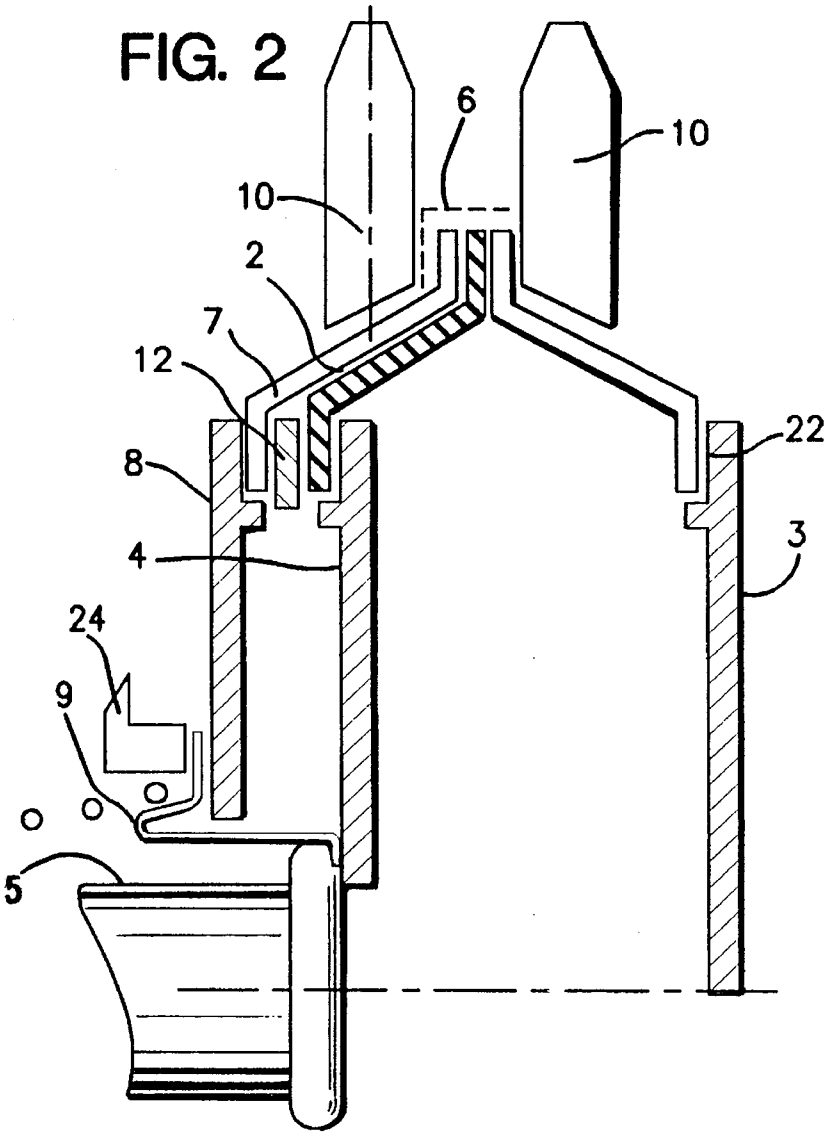
FIG. 2 is a schematic view in half-section of a "push-pull" type jack according to the invention.
Figure 1:
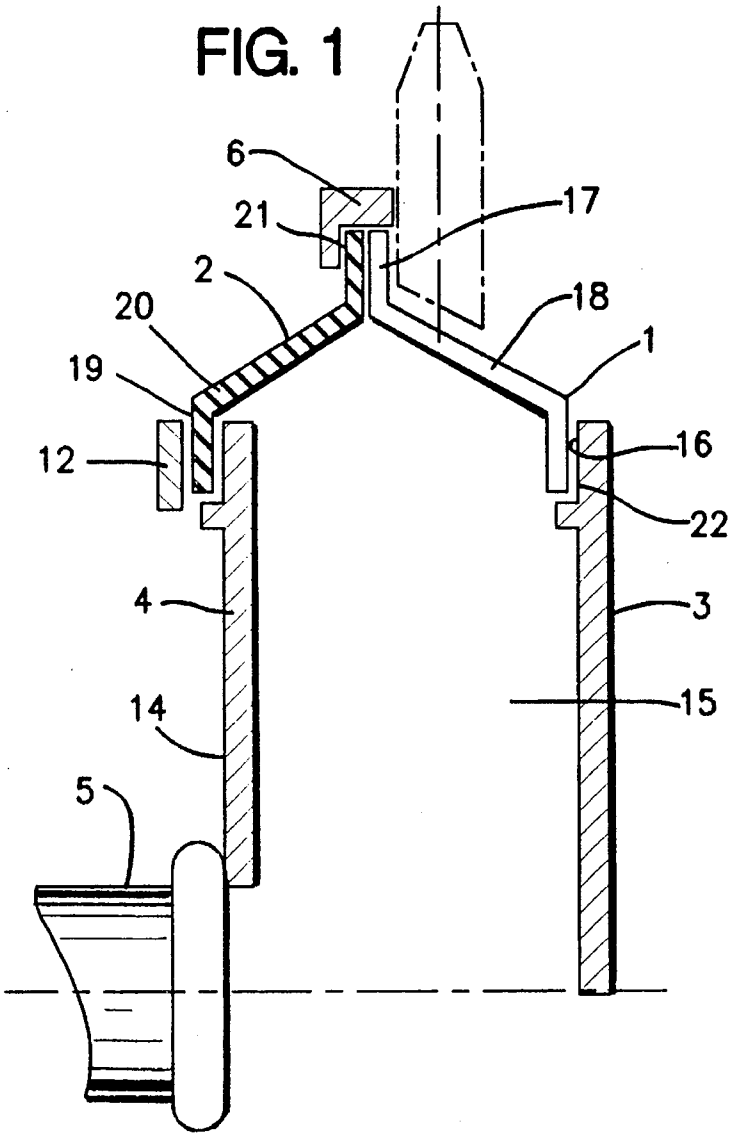
FIG. 1 is a schematic view in half-section of a jack according to the invention.

According to the invention, the jack comprises a rigid jack body 1 secured to a membrane 2, and disks 3 and 4 closing at least partially respectively the openings 15 and 14 provided in the body 1 and the membrane 2 so as to delimit a chamber adapted to be subjected either to atmospheric pressure or to negative pressure.

The rigid jack body 1 has, in the described embodiments, the general shape of a basin having a bottom 16 having an opening 15 and a truncated conical portion 18 prolonged by a projecting edge 17 which, as seen from above, has an oblong shape.

This rigid jack body 1 is secured, preferably at the level of its peripheral edge 17, to the external edge of the deformable membrane 2. This membrane has in the described embodiment a shape substantially similar to the body. Thus, it also is in the form of a basin comprising a bottom 19 provided with an opening 14 and a truncated conical portion 20 prolonged by a projecting edge 21.

In the examples shown in FIGS. 1 to 4, the membrane 2 and the jack body 1 are in contact by their respective peripheral edges 17, 21 which are maintained secured together by means of a ring 6 forming a bond maintaining secured together the external surfaces of the projecting peripheral edge 17 of body 1 by ultrasonic welding. Of course, any other means for securing together the membrane 2 and the body 1 could be envisaged. Similarly, the shapes of the body 1 and of the membrane 2 constitute only examples of shapes of embodiment of the invention.

The openings 14 and 15 provided respectively in the surfaces forming the bottom 19 and 16 of the membrane 2 and the body 1 are preferably disposed substantially centrally within the surfaces forming the bottom 19 and 16 and are generally of circular section. These openings 14 and 15 are respectively closed at least partially by means of disks 4 and 3 in the form of covers.

These disks are plates of identical shape but of dimensions slightly greater than the opening provided in the surface forming the bottom of the basin or the body. This plate has on its face that comes to bear against the internal or external edges of the opening 14 or 15 two recesses 22 extending from the external edge of the plate and adapted to permit the reception of the plate on at least one portion of its thickness within the opening 14 or 15. Welding, preferably ultrasonic, is then practiced between the edges of the recess 22 and the edges of the opening 14 or 15. When the disks are positioned, the chamber is closed. This chamber comprises however at least one air inlet. This air inlet is preferably disposed on the truncated conical portion 18 of the rigid jack body 1 and is constituted for example by a pipe or male ferrule 10 providing a channel for placing in communication the chamber with a negative pressure source or with the atmosphere. This placing in communication is preferably effected by means of a female ferrule conjugated with the male ferrule, said female ferrule forming the end of a conduit itself connected to the source of negative pressure.

Figure 7:
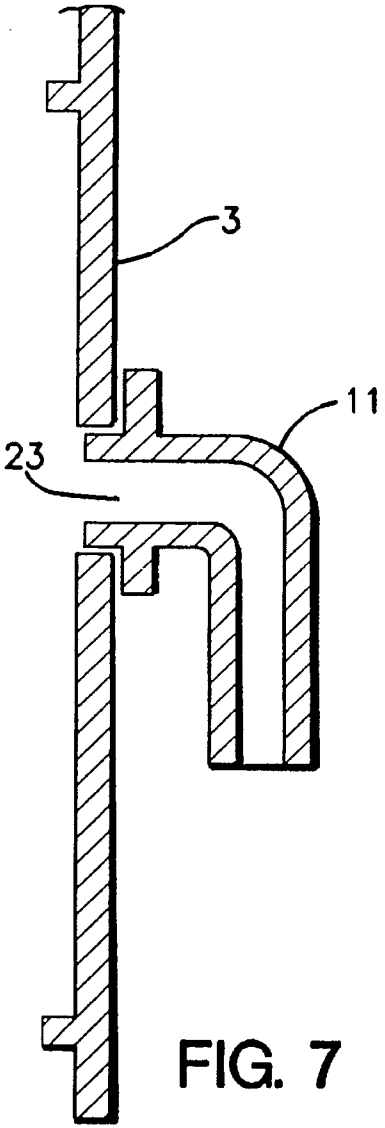
FIG. 7 is a side view of means for incorporation of a pipe in said chamber.

In another embodiment of the invention shown in FIG. 7, the air inlet is constituted by the opening provided in the bottom of the jack body 1. This opening is reduced after positioning the disk 3. This disk itself has a substantially central opening 23 connected in a sealed manner to a male ferrule or pipe 11 which will be connected in the same way as that previously described, to a source of negative pressure.

As to the disk 4 which closes at least partially the opening 14 provided in the membrane, it also comprises an opening in which is secured in a sealed manner the axially disposed shaft 5 of the jack. This shaft 5 transmits directly the movement of the membrane 2 to the member to be actuated. Of course, this shaft can have any shape as a function of the purpose of the jack and its use. It is to be noted in accordance for example with FIG. 1 that there could be used a counterdisk 12 to maintain the membrane in a sealed and secure manner within the neck of the disk 4.

In the type of configuration described above, when the chamber is subjected to negative pressure, the disk 4 closing at least partially the opening provided in the membrane 2 coacts with said deformable membrane 2 so as to come into abutment against the bottom of the basin. To return to the deployed position, which is to say of maximum size shown in FIG. 1, there will be used either a spring disposed within the chamber and used as a return means for the jack to its starting position, or a configuration according to FIG. 2.

In this configuration, there is associated with the first rigid jack body 1, the so-called rear body, a second jack body 7, the so-called forward body, disposed symmetrically to the rear body. This forward body is also at least partially closed by a disk 8 having an opening permitting the passage of the shaft 5 of the jack, the seal between the opening and the shaft being ensured by means of a second membrane 9. As to the seal of the membrane 9 with the disk 8, it is ensured by ultrasonic welding and at least one member 24 having the shape of a flexible hook. This member 24 permits moreover to ensure by clipping the securement of the jack on various supports. This member can be of various shapes and adapted to the manner of securement imposed by the supports which must receive them. This forward body 7 is provided with an air inlet 10 of a type similar to or different from the air inlet of rear body 1. The forward body 7 and the rear body 1 are secured together at the level of their projecting edges by a ring 6 which can be of the type described above. In the plane of the joint of said bodies is gripped the external edge of the membrane 2 which corresponds to its peripheral projecting edge when the membrane has the shape of a basin. In this arrangement, there is obtained a jack of the push-pull type which requires no return means because the two chambers thus delimited are independent and each comprise an air inlet 10. Thus, when the rear chamber is subjected to negative pressure, the position occupied by the jack is the position in which the shaft of jack 5 is retracted the maximum. Conversely, when it is the forward chamber, which is to say the one delimited by the forward rigid body 8 which is subjected to negative pressure, the shaft of jack 5 is extended and occupies a position identical to that shown in FIG. 2. It is sometimes also necessary to use multiposition jacks or jacks whose path of movement is susceptible to being varied considerably from one use to another. The jack described above is interesting because it can be transformed easily by means of members already described above to obtain effectively a multiposition jack.

Figure 3:
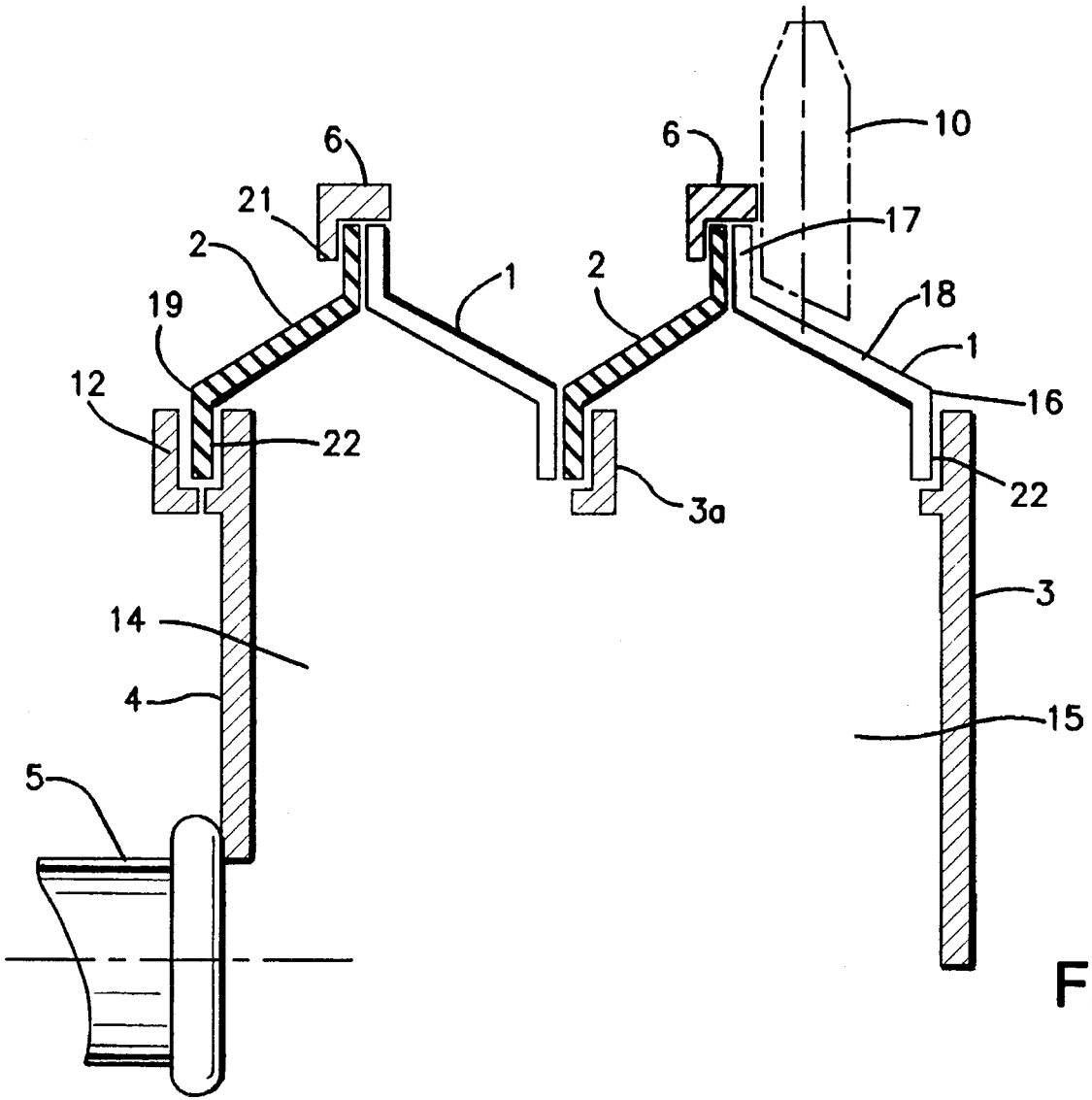
FIG. 3 is a schematic view in half-section of a jack formed by several modules disposed in series.

It will be assumed in the description which follows that the basic module is formed by a body 1, a deformable membrane 2 and at least one disk 3 or 4. Thus, to obtain a multiposition jack, several modules are assembled so as to delimit several contiguous chambers, the connection between two adjacent modules being effected by one and the same disk closing at least partially both the body of a module and the membrane of the adjacent module and maintaining secured the membrane of the body. There is thus obtained a configuration according to FIGS. 2 or 3. In this type of configuration, the disk common to the two modules can be hollow or not, so as to obtain modules mounted in series or in parallel. In the case of a jack formed from modules mounted in series such as shown in FIG. 3, it will be noted that the disk common to two adjacent modules, namely the disk designated **3*a* in the illustrated example, is hollow. Thus, when one of the chambers is subjected to negative pressure by means of an air inlet 10, the two chambers are subjected to this negative pressure and the disk 4 comes into abutment against the front of the body of jack 1 of the first chamber and the disk 3*a* comes into abutment against the bottom of the body of jack 1 belonging to the second chamber. This type of jack having two modules is therefore adapted to occupy at least two positions, a position of maximum size as shown in FIG. 3** and a position of minimum size or retracted position such as described above.

Figure 4:
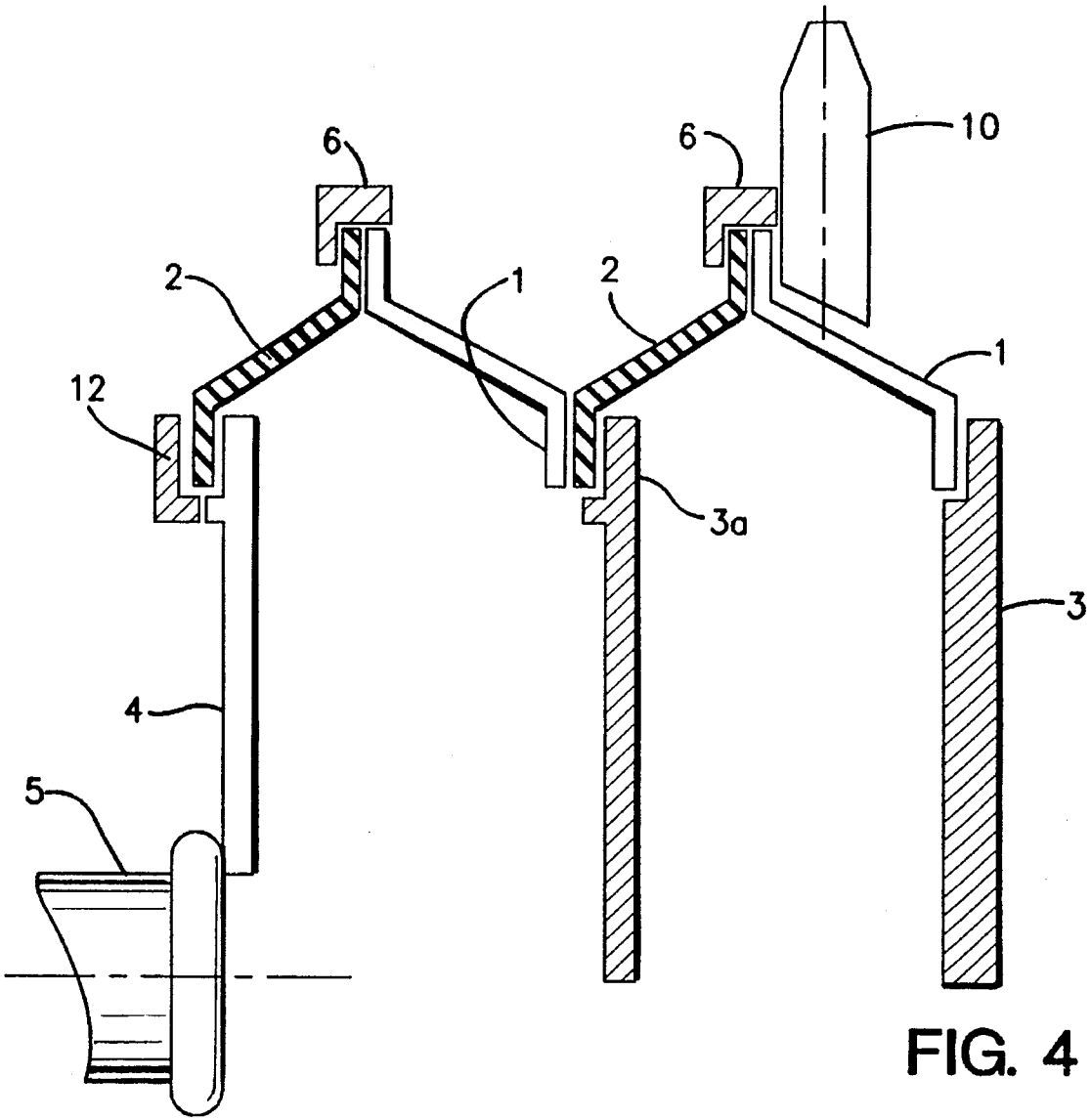
FIG. 4 is a schematic view in half-section of a jack formed by several modules disposed in parallel.
Figure 6:
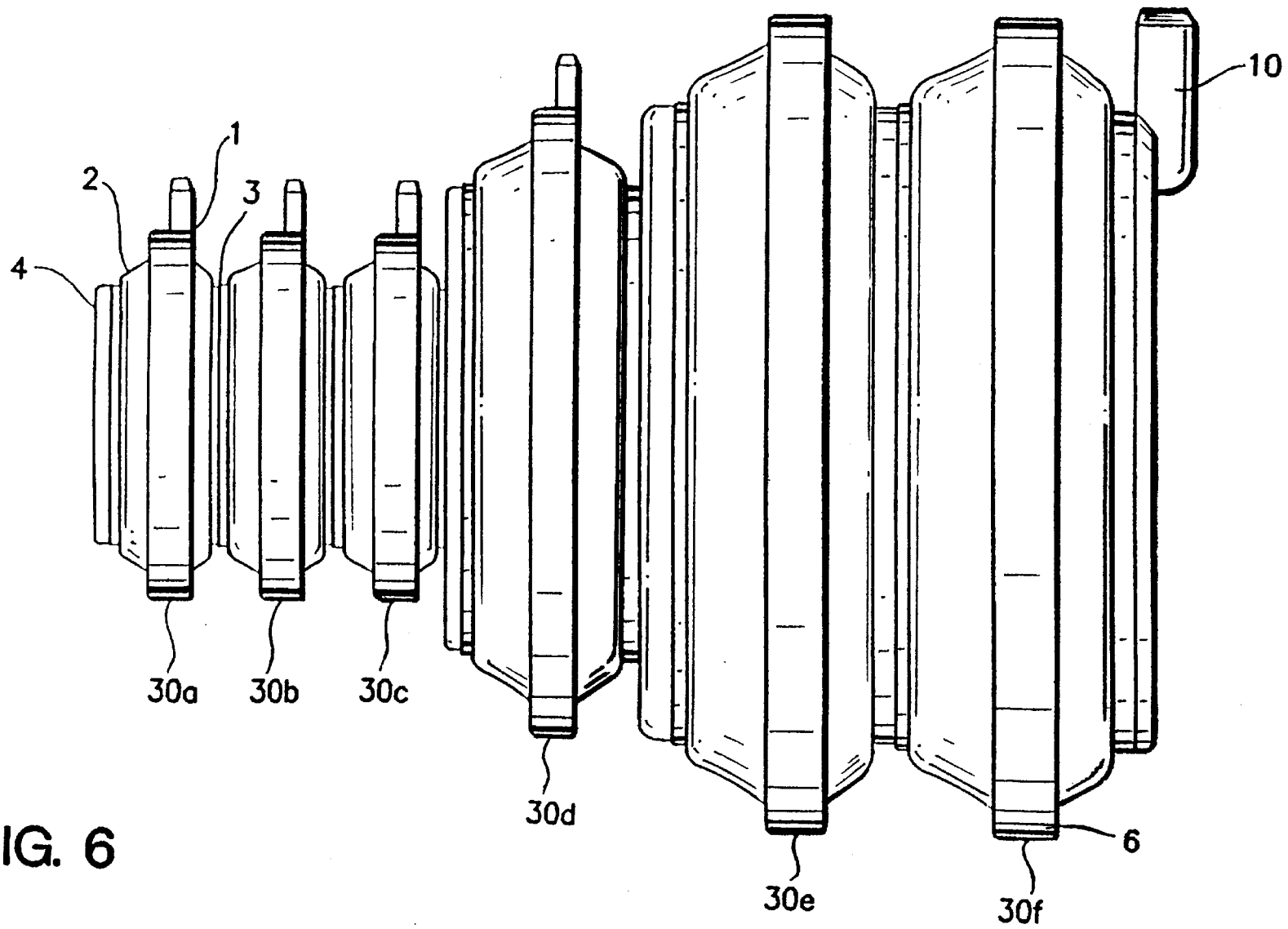
FIG. 6 is a view of an example of assembly of modules to produce a jack according to the invention.

If on the contrary the modules are mounted in parallel as shown in FIG. 4, the intermediate disk **3*a*, serving as a common element of the forward chamber and the rear chamber, is solid. In this case, each module is provided with an air inlet permitting placing under negative pressure one of the chambers independently of the other chamber. There is thus obtained a module such as shown in FIG. 4 which has at least three working positions: a position in which the forward chamber is subjected to negative pressure, a position in which the rear chamber is subjected to negative pressure, and a position in which the two chambers are subjected to negative pressure, or even a fourth position in which the two chambers are at atmospheric pressure, as shown in FIG. 4. It is obviously possible, as shown in FIG. 6, to assemble the modules mounted both in parallel and in series. Thus, the example of FIG. 6 is constituted by a jack having six modules, the modules 30*e* and 30*f* being mounted in series, the modules 30*a*, 30*b*, 30*c*, 30*d*, (30*e* 30*f*) being mounted in parallel, the actuator 30*d* being an actuator of the push-pull type and the actuators 30*a*, 30*b*, 30*c*, 30*d* being of different dimensions with respect to the actuators 30*e*, 30*f***. There is thus obtained jacks whose path of movement can be varied as desired and permitting a large number of possibilities and, moreover, the force of the jack can be variable as a function of the chamber subjected to negative pressure because the chambers have different volumes; there is thus obtained a proportional jack. Despite this great modularity of the jack, the assembly of the members is susceptible to be obtained from a same mold and their number is less than five.

Figure 5:
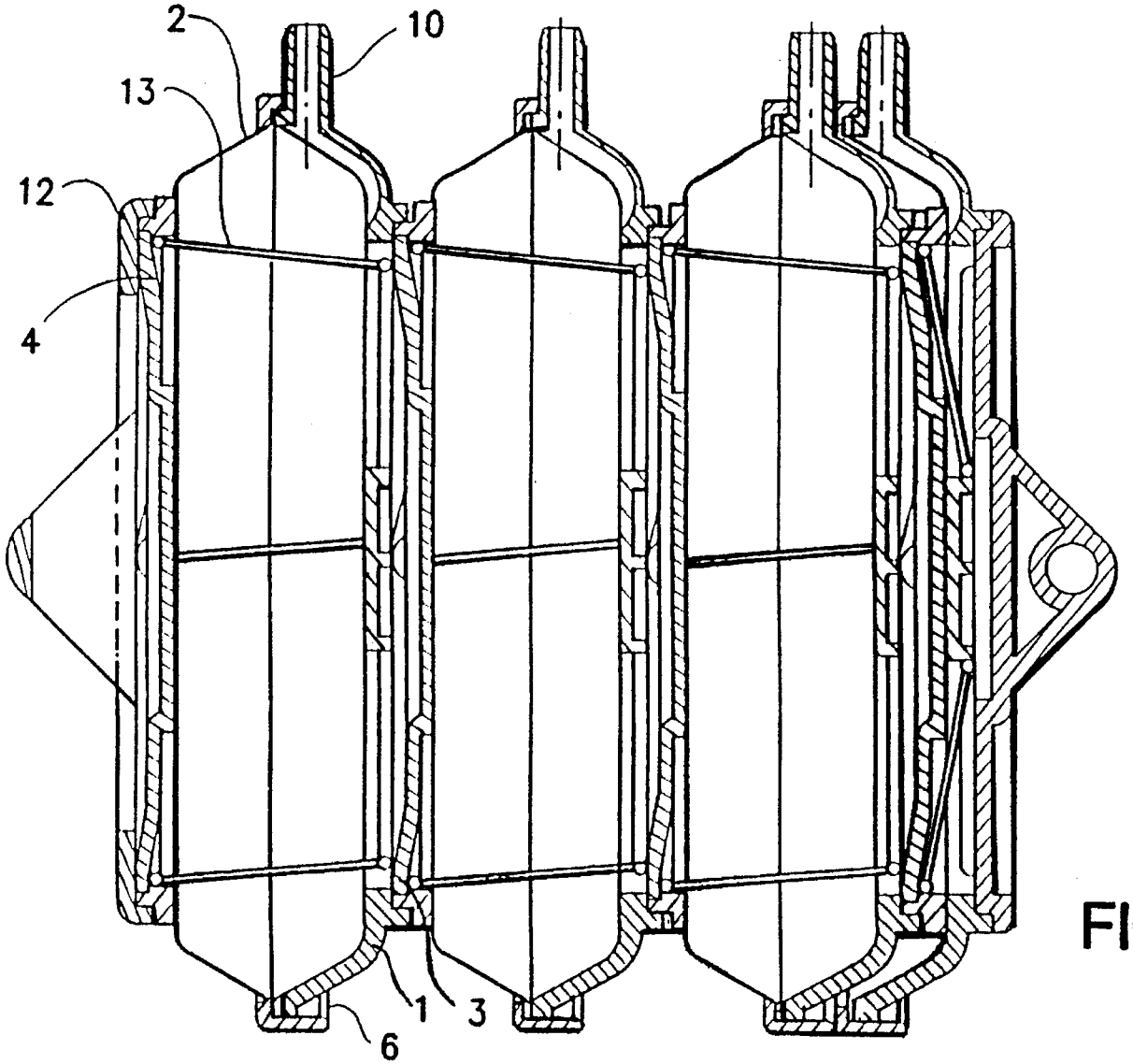
FIG. 5 is a cross-sectional view of a jack comprising several modules mounted in parallel.

It is also possible to provide, according to FIG. 5, restraining means 13 for the jack chamber particularly when the loads to be moved are heavy. These restraining means 13 connect the disk closing the membrane with the rigid body 1 of the jack. These means are mounted pivotally and/or slidably on the disk closing the membrane and slidably and/or pivotally on the bottom of the body of the jack and if desired on the disk closing at least partially the bottom of the body of the jack. These restricting means 13 collapse during the placing of the chamber under negative pressure as shown by the first module to the right in FIG. 5 and, by contrast, limit the path of the disk closing the membrane when said chamber is placed under atmospheric pressure, as shown by the three other modules in FIG. 5. These restricting means are more particularly used in the case of the use of a jack for heavy loads.

I claim:

1. Pneumatic jack comprising a rigid jack body secured to an external edge of a deformable membrane so as to limit with said membrane a chamber of variable volume adapted to be subjected either to atmospheric pressure or to negative pressure, by means of an air inlet provided in said chamber, the body and the membrane each having an opening substantially centrally disposed, and a disk for at least partially closing each opening, each disk having a contour identical to but of a size slightly greater than the opening, said membrane having the general shape of a basin forming a bottom which is provided with a substantially central opening closed at least partially by the disk secured to the periphery of the opening, said disk coacting with the membrane so as to come into abutment against the bottom of the basin when the chamber is subjected to negative pressure, and a jack shaft sealingly secured in an opening of the disk secured to the membrane for directly transmitting the movement of the membrane to a member to be actuated.

2. Pneumatic jack according to claim 1, wherein said body has the shape of a basin with a peripheral edge which serves to maintain the membrane, said basin forming a bottom which includes a substantially central opening closed at least partially by the disk.

3. Pneumatic jack according to claim 1, further including several contiguous chambers obtained by assembly of modules, each module comprising at least on body and one membrane, wherein two adjacent modules are connected by a single and same disk closing at least partially both the body of one module and the membrane of an adjacent module, and maintaining secured the membrane of the body.

4. Pneumatic jack according to claim 3, wherein the modules are assembled by at least one of hollow and solid disks so as to obtain modules mounted in at least one of series and parallel.

5. Pneumatic jack according to claim 1, wherein the air inlet of one chamber is provided by the rigid body of the jack and comprises a pipe for fluid connection via a conduit to a source of negative pressure.

6. Pneumatic jack according to claim 1, wherein the air inlet of the chamber comprises an aperture provided in the bottom of said body, and at least partially closed by the disk, for connection via at least one of a ferrule and a conduit to a source of negative pressure.

7. Pneumatic jack according to claim 1, further including restraining means for connecting the disk closing the membrane with the rigid body of the jack, said restraining means being movably mounted on the disk closing the membrane and on the bottom of the body, said restraining means collapsing when the chamber is placed under negative pressure and limiting the path of the disk closing the membrane when said chamber is placed under atmospheric pressure.

8. Pneumatic jack according to claim 1, wherein the rigid body of the jack is maintained at its periphery of the external edge of the deformable membrane by means of a ring which grips the membrane and a plate against the projecting peripheral edge of the body of the jack.

9. Pneumatic jack according to claim 1, further including a second body disposed symmetrically relative to the rigid body for maintaining said rigid body secured at a periphery of the external edge of the deformable membrane, said external edge of the membrane being disposed in the plane of the joint of said rigid body and said second body.

10. Pneumatic jack according to claim 9, wherein the second body forms a forward surface of the jack and is provided with a disk having an opening for permitting the passage of a shaft of the jack.

11. Pneumatic jack according to claim 10, further comprising a second membrane for ensuring a seal between the opening for permitting passage of the shaft of the jack and the shaft.

12. Pneumatic jack comprising a rigid jack body secured to an external edge of a deformable membrane so as to limit with said membrane a chamber of variable volume adapted to be subjected either to atmospheric pressure or to negative pressure, by means of an air inlet provided in said chamber, the body and the membrane each having an opening substantially centrally disposed, and a disk for at least partially closing each opening, each disk having a contour identical to but of a size slightly greater than the opening, and restraining means for connecting the disk closing the membrane with the rigid body of the jack, said restraining means being movably mounted on the disk closing the membrane and on the bottom of the body, said restraining means collapsing when the chamber is placed under negative pressure and limiting the path of the disk closing the membrane when said chamber is placed under atmospheric pressure.

* * * * *